US006213903B1

(12) United States Patent
Ford

(10) Patent No.: US 6,213,903 B1
(45) Date of Patent: Apr. 10, 2001

(54) TAPE FOR HOCKEY STICKS

(76) Inventor: B. Douglas Ford, P.O. Box 234, Wolfe Island, Ontario (CA), K0H 2Y0

( * ) Notice: Subject to any disclaimer, the term of this patent is extended or adjusted under 35 U.S.C. 154(b) by 0 days.

(21) Appl. No.: 09/269,072

(22) PCT Filed: Mar. 10, 1998

(86) PCT No.: PCT/CA98/00204

§ 371 Date: Mar. 19, 1999

§ 102(e) Date: Mar. 19, 1999

(87) PCT Pub. No.: WO98/40132

PCT Pub. Date: Sep. 17, 1998

(30) Foreign Application Priority Data

Mar. 11, 1997 (CA) ..... 2199750

(51) Int. Cl.[7] ..... A63B 59/14
(52) U.S. Cl. ..... 473/563
(58) Field of Search ..... 473/563, FOR 189

(56) References Cited

U.S. PATENT DOCUMENTS

| | | | | |
|---|---|---|---|---|
| 2,912,245 | * | 11/1959 | Gardner et al. | 473/563 |
| 3,458,194 | | 7/1969 | Coles | 273/67 |
| 4,651,990 | * | 3/1987 | Profit | 473/563 |
| 5,127,649 | | 7/1992 | Carbonero | 273/67 A |
| 5,558,326 | * | 9/1996 | Adamson et al. | 473/563 |
| 5,836,841 | * | 11/1998 | Fell | 473/563 |

FOREIGN PATENT DOCUMENTS

| | | | |
|---|---|---|---|
| 2118740 | | 9/1995 | (CA) . |
| 2194519 | * | 7/1997 | (CA) . |
| 547946 | | 9/1942 | (GB) . |

* cited by examiner

*Primary Examiner*—Mark S. Graham
(74) *Attorney, Agent, or Firm*—McFadden, Fincham

(57) ABSTRACT

There is disclosed a protective blade wrap (10) for wrapping the blade of a hockey stick. The wrap comprises an adhesive unitary sheet material which has a front panel (14) and rear panel (16) and a releasable backing sheet (20). The front panel (14) is of a dimension which corresponds to a dimension of a front surface of a blade of a hockey stick to be covered and the rear panel (10) is of a dimension corresponding to a dimension of a rear surface of a blade of a hockey stick to be covered.

4 Claims, 2 Drawing Sheets

TAPE FOR HOCKEY STICKS

The present invention relates to a tape for use in sporting equipment. More particularly, the present invention relates to a tape wrap for wrapping the blade of a hockey stick.

It is desirable in the sport of hockey to wrap the blade of a hockey stick with tape to aid in strengthening the blade and preventing chipping or cracking of the blade in use. Such wrapping of the hockey stick blade provides for a longer life for the stick.

The conventional method for taping a hockey stick blade involves the intricate and precise winding of adhesive or function tape with a width of approximately one inch about the blade of the hockey stick. This task is time consuming and is further a very difficult task to carry out for young children and those with disabilities such as arthritis. Additionally, the conventional tapes for wrapping hockey stick blades do not readily permit the display of large, easy to see graphics and/or lettering on the taped surface of the hockey stick blade.

One feature of the present invention is to provide a wrap for a hockey stick blade in the form of at least one solid sheet having adhesive properties and a backing sheet, which is easy to use and which provides good strength properties when applied to the blade of a hockey stick. A further feature of a preferred form of the present invention is to provide such a wrap which permits the printing of large, easy to see graphics or lettering thereon.

In accordance with one embodiment of the present invention there is provided a hockey stick having a protective wrap on the blade portion. The wrap comprises a continuous one-piece sheet of flexible material having a pair of contiguous major sections; one of the major sections being in juxtaposition with a front surface of the blade portion and the other of the major sections being in juxtaposition with a rear surface of the blade portion. The major sections are secured to the opposed surfaces of the blade by way of an adhesive.

Preferably, the major sections of the wrap comprise a front section and a rear section which have height dimensions which correspond to the height dimensions of the opposed faces of the blade. Preferably, the front and rear sections of the wrap extending along substantially a major portion of the length of the blade.

In a preferred form, the wrap includes a third panel which is of smaller dimensions than the major sections. The third panel is affixed to one of the opposed faces of the blade in an overlapping manner with one of the major sections.

Another embodiment of the present invention provides a wrap for use in wrapping a blade of a hockey stick where the wrap comprises a sheet of flexible material having at least first and second panels and an adhesive back portion. The sheet is of a flexible material and of a dimension suitable for wrapping around a blade of a hockey stick. The wrap further includes a releasable backing sheet in releasable engagement with the adhesive back portion of the flexible sheet.

A still further embodiment of the present invention provides a blade wrap for wrapping the blade of a hockey stick. The blade wrap comprises an adhesive unitary sheet material having a front panel, rear panel and a top panel and having a releasable backing sheet. The front panel is of a dimension corresponding to a dimension of a front surface of a blade of a hockey stick to be covered. The rear panel is of a dimension corresponding to a dimension of a rear surface of a blade of a hockey stick to be covered. The top panel is of a smaller dimension than said front and rear panels and is adapted to wrap around a top surface of a blade of a hockey stick and be affixed to a rear surface of the blade.

Preferably the releasable backing sheet has first, second and third panels which correspond to the front, rear and top panels of the sheet material and which are individually removable. In a particularly preferred arrangement, die cuts are utilized to separate the panels and permit their individual removal.

The sheet material is preferably of a type which would permit the printing of indicia, in the form of team names, team logos or advertisements thereon.

Having thus generally described the invention, reference will now be made to the accompanying drawings, wherein.

Figure 1:
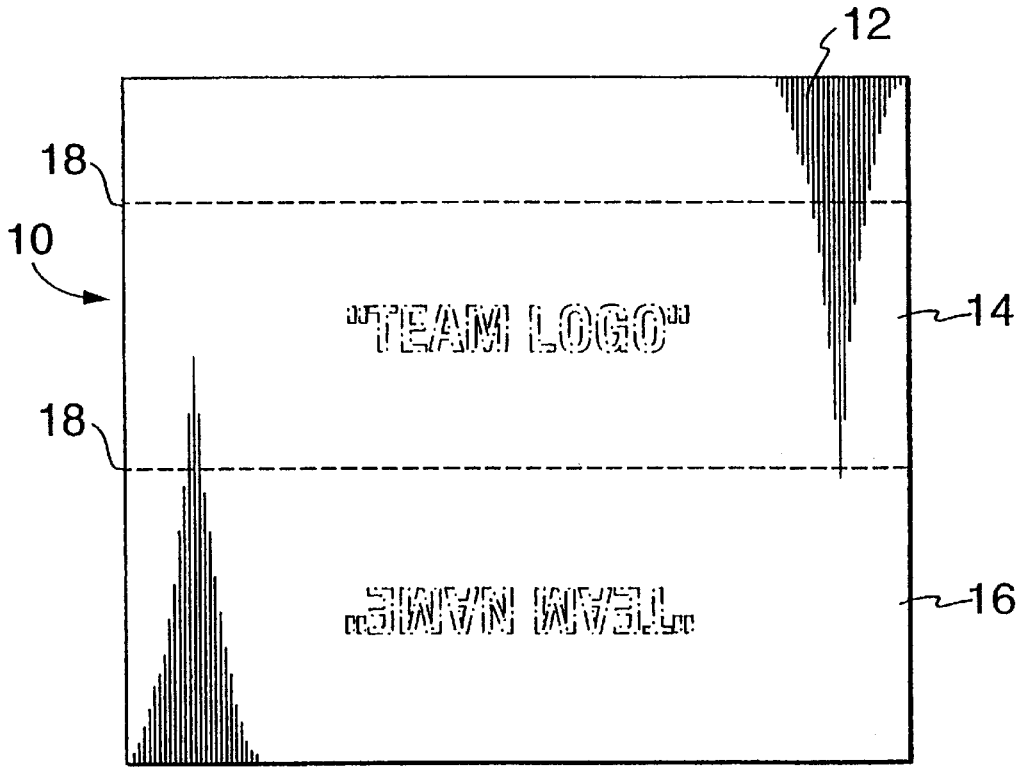
FIG. 1 is a top plan view of the hockey stick blade wrap of the present invention.

Looking initially at FIG. 1, this figure illustrates the hockey stick blade wrap 10 of the present invention with example lettering and graphics thereon. The blade wrap 10 has a top panel 12, a front panel 14, and a rear panel 16. The top panel 12, front panel 14 and rear panel 16 may be separated by fold lines 18. The front panel 14 and rear panel 16 may be of various dimensions but in general, are of dimensions which correspond to the dimensions of the front and rear faces of the hockey stick blade to be covered. The blade wrap 10 can be made of any suitable material which has adhesive properties such as cloth tape, friction tape or any other suitable material.

As further illustrated in FIG. 1, the blade wrap 10 may have lettering or graphics printed on the top panel 12, front panel 14 and/or rear panel 16. The lettering or graphics applied to the blade wrap 10 may be of any desirable form, such as advertisements, team names, team logos, etc. It is preferred that the lettering or graphics on the rear panel 16 be oriented in an "upside down" manner so that when the blade wrap 10 is wrapped around the blade of a hockey stick, as will be described hereinafter, the lettering/graphics will be properly oriented for easy identification/reading.

The blade wrap 10 includes an adhesive portion on its rear face (not shown) to permit secure application to the blade of a hockey stick. The adhesive portion may be present on the entire back surface of the blade wrap 10 or alternatively, only select portions of the top panel 12, front panel 14 and/or rear panel 16 may include an adhesive portion.

Figure 2:
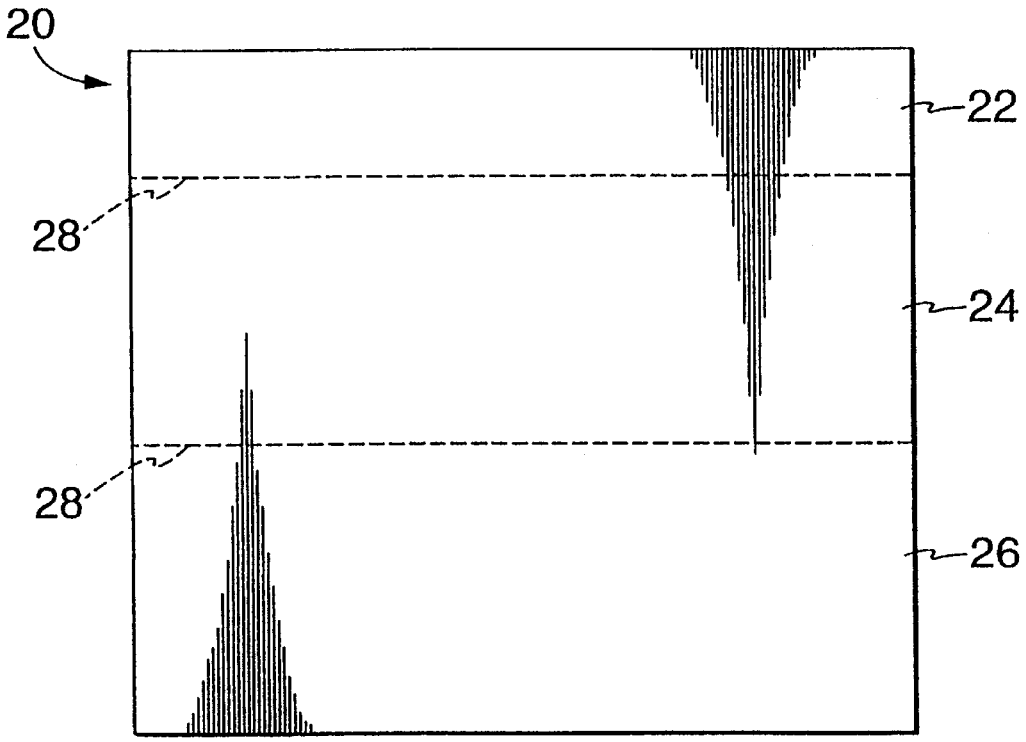
FIG. 2 is a back plan view of the hockey stick blade wrap of the present invention.

As illustrated in FIG. 2, the blade wrap 10 has a backing sheet 20 which protects the adhesive portion on the back of the blade wrap 10. The backing sheet 20 is of a suitable material such as silicon paper or release paper which would permit its easy removal from the back of the blade wrap 10. The backing sheet 20, as illustrated in FIG. 2, is preferably comprised of three panels, a top backing panel 22, an intermediate backing panel 24 and a bottom backing panel 26. The top backing panel 22 corresponds to the top panel 12 of the blade wrap 10; the intermediate backing panel 24 corresponds to the front panel 14 of the blade wrap 10; and the bottom backing panel 26 corresponds to the rear panel 16 of the blade wrap 10.

In a preferred form, the top backing panel 22, front backing panel 24 and rear backing panel 26 are separated from each other by die cuts 28 in such a manner that each of these backing panels 22, 24 and 26 can be separated from the blade wrap 10 independently. Although this is the preferred arrangement of the backing sheet 20, it will be appreciated that the backing sheet can also be in the form of a single unitary backing sheet which is removable in one piece from the blade wrap 10 or in any other suitable panel arrangements.

Figure 3:
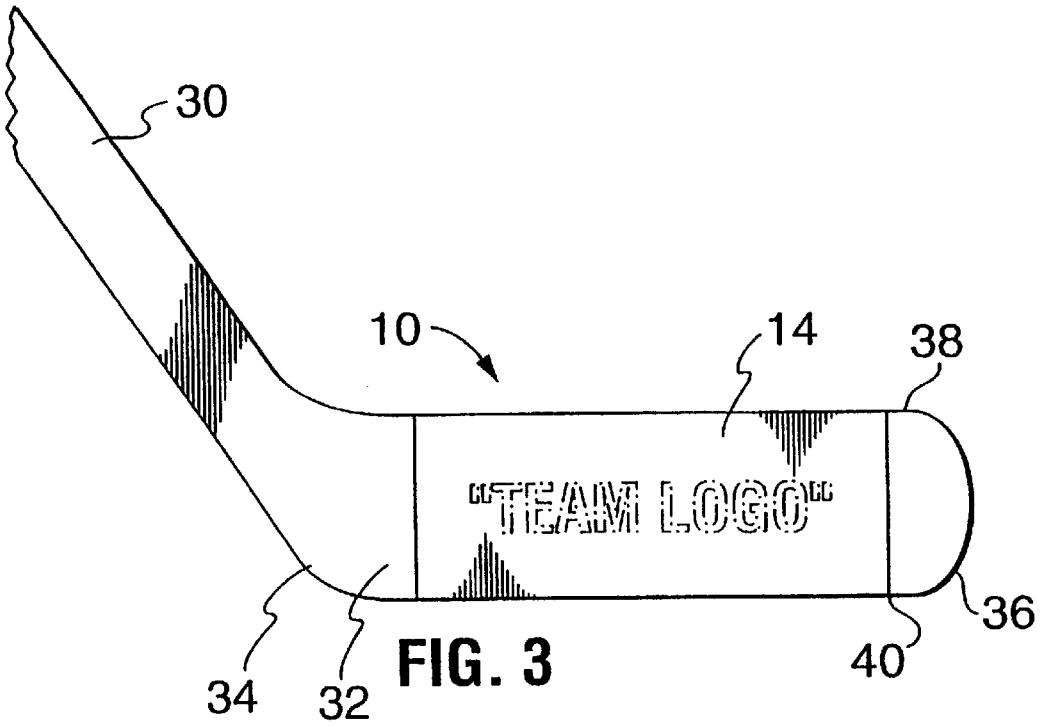
FIG. 3 is a front elevational view of the hockey stick blade wrap of the present invention affixed to a hockey stick.
Figure 4:
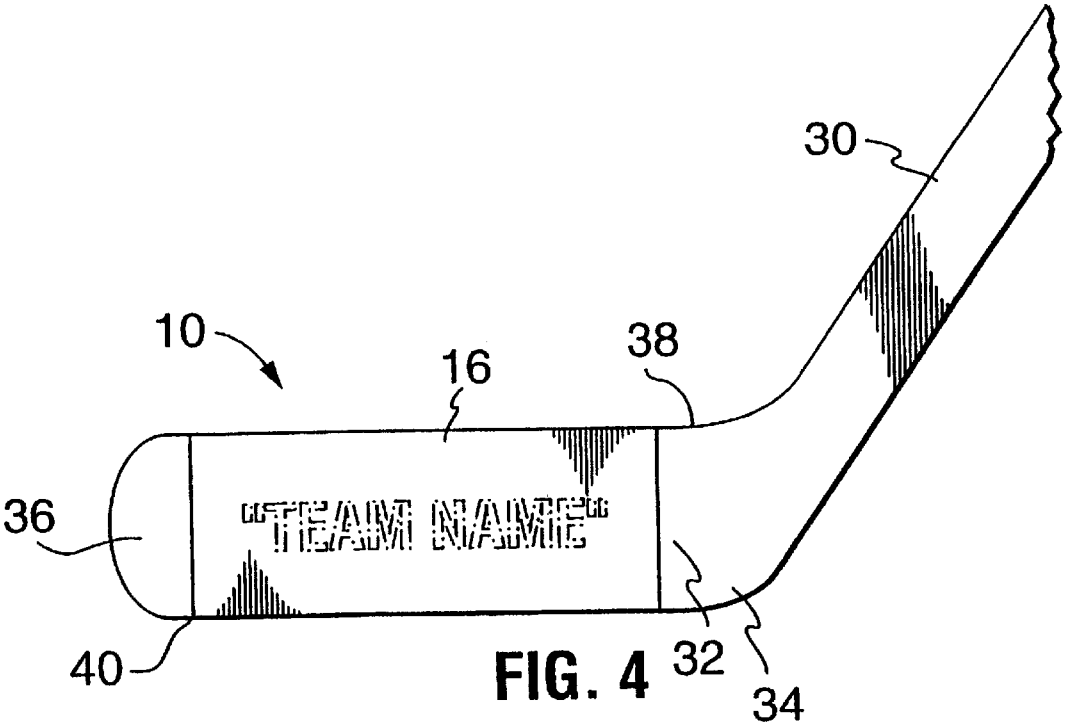
FIG. 4 is a rear elevational view of the hockey stick blade wrap of the present invention affixed to a hockey stick.

FIGS. 3 and 4 illustrate the blade wrap 10 applied to the blade 32 of a hockey stick 30. FIG. 3 is a front view showing the front panel 14 of the blade wrap 10 positioned on the front face of the blade 32 of the hockey stick 30; and FIG. 4 is a rear view showing the rear panel 16 of the blade wrap 10 positioned on the rear face of the blade 32 of a hockey stick 30.

These figures illustrate the blade wrap 10 affixed on the blade 32 in a position spaced inwardly from the heel 34 and inwardly from the toe 36 of the blade 32. It will be understood, however, that the blade wrap 10 may be of a dimension to cover the entire area between the heel 34 and toe 36 of the blade 32; the positioning of the blade wrap and thus it's dimensions depend on individual preference.

The preferred method of applying the blade wrap 10 to the blade 32 of a hockey stick 30 will now be described, although it will be appreciated that various methods can be utilized.

First, the intermediate panel 24 of the backing sheet 20 which is adjacent to the front panel 14 of the blade wrap 10 is removed. The thus exposed back surface of the front panel 14, which includes an adhesive portion, is applied right-side up to the front surface of the blade 32 of a hockey stick 30. At this point any wrinkles are smoothed out.

Next the top backing panel 22 of the backing sheet 20, which is adjacent to the top panel 12 of the blade wrap 20, is peeled off. The top panel 12 is folded over the top 38 of the blade 32 and pulled taut. The adhesive portion of the top panel 12 is affixed to the back of the blade 32 and any wrinkles are smoothed out.

Finally, the bottom backing panel 26 which is adjacent to the rear panel 16 of the blade wrap 10 is peeled off. The rear panel 16 is pulled taut under the bottom surface 40 of the blade 32 and affixed to the back surface of the blade 32 overlapping the previously applied top panel 12.

It is preferred that any lettering or graphics applied to the blade wrap 10 should be applied in an orientation such that when the wrap is applied to the blade 32 of a hockey stick 30, both the lettering and graphics on the front panel 14 and rear panel 16 will appear in a right-side up manner to permit easy recognition/identification. This would involve the lettering or graphics being applied in a "right-side up" manner on the front panel 14 and in an "upside down" manner on the rear panel 16. Indicia could also be oriented on the blade wrap 10 in other fashions with suitable end results by having modified back panel arrangements and application instructions.

As noted hereinabove, the blade wrap 10 may be of any suitable material which includes an adhesive member on its back surface. Preferably, the material is of a cloth or function tape which would readily permit the printing of lettering or logos thereon.

Further, it is preferred that the entire back surfaces of the top panel 12, from panel 14 and rear panel 16 be adhesive.

The dimensions of the blade wrap 10 can be decreased for children's ice hockey sticks and increased for goalie sticks. With respect to goalie sticks the blade wrap can be utilized for both the blade and the paddle portion if desired.

Although reference is made to hockey sticks through out this application it will be understood that the blade wrap of the present invention can be utilized in conjunction with other sporting equipment where taping is desirable such as in roller and ball hockey sticks, and the like.

Although preferred embodiments of the present invention have been described above, it is not limited thereto and it will be apparent to those skilled in the art that numerous modifications form part of the present invention insofar as they do not depart from the spirit, nature and scope of the claimed and described invention.

I claim:

1. A blade wrap for wrapping the blade of a hockey stick, characterized by adhesive unitary sheet material having a front panel, rear panel and top panel and having a releasable backing sheet wherein said front panel is of a dimension corresponding to a dimension of a front surface of a blade of a hockey stick to be covered, said rear panel is of a dimension corresponding to a dimension of a rear surface of a blade of a hockey stick to be covered; said top panel being of a smaller dimension and adapted to wrap around a top surge of a blade of a hockey stick and be affixed to a rear surface of the blade.

2. The blade wrap as claimed in claim 1, wherein said releasable backing sheet has first, second and third panels corresponding to the front, rear and top panels of said sheet material, each of said first, second and third panels being individually removable.

3. The blade wrap as claimed in claim 2, wherein said first, second and third panels of said backing sheet are separated by die cuts.

4. A hockey stick having a blade with opposed faces, said blade having a protective wrap on said opposed faces, characterized in that said wrap comprises:

a continuous one piece sheet of flexible material having a pair of contiguous major sections and a panel of smaller dimension than said major sections, one each of said sections being in juxtaposition with a respective one of each of said opposed faces and secured about said blade with adhesive means, said panel being affixed to one of said opposed faces of said blade in an overlapping manner with one of said major sections.

* * * * *